US010746462B2

(12) United States Patent
Poulin et al.

(10) Patent No.: US 10,746,462 B2
(45) **Date of Patent: *Aug. 18, 2020**

(54) METHOD FOR CONSTRUCTING A COLD BOX MODULE

(71) Applicant: L'Air Liquide, Societe Anonyme pour l'Etude et l'Exploitation des Procedes Georges Claude, Paris (FR)

(72) Inventors: Gilles Poulin, Montreal (CA); Yves Hardy, Saint-Sauveur (CA); Claude Granger, Beloeil (CA); Yoland Plamondon, Pepentigny (CA); Minh Huy Pham, Houston, TX (US); May Yee Wendy Yip, Sugar Land, TX (US)

(73) Assignee: L'Air Liquide Societe Anonyme Pour L'Etude Et L'Explotation Des Procedes Georges Claude, Paris (FR)

( * ) Notice: Subject to any disclaimer, the term of this patent is extended or adjusted under 35 U.S.C. 154(b) by 86 days.

This patent is subject to a terminal disclaimer.

(21) Appl. No.: 15/952,023

(22) Filed: Apr. 12, 2018

(65) Prior Publication Data

US 2018/0299197 A1 Oct. 18, 2018

Related U.S. Application Data

(60) Provisional application No. 62/484,561, filed on Apr. 12, 2017.

(51) Int. Cl.
*F25J 3/04* (2006.01)
*B65D 90/02* (2019.01)

(52) U.S. Cl.
CPC ..... *F25J 3/04975* (2013.01); *B65D 90/028* (2013.01); *F25J 3/0489* (2013.01);
(Continued)

(58) Field of Classification Search
CPC .... F25J 3/04975; F25J 3/0489; F25J 3/04896; F25J 2290/42; F25J 2290/70; F25J 3/04412; F25J 3/04654; B65D 90/028
See application file for complete search history.

(56) References Cited

U.S. PATENT DOCUMENTS

| | | | |
|---|---|---|---|
| 6,202,305 | B1 | 3/2001 | Bracque et al. |
| 6,711,868 | B1 | 3/2004 | Faure et al. |
| 2004/0255450 | A1 | 12/2004 | Wilhelm |

FOREIGN PATENT DOCUMENTS

| | | |
|---|---|---|
| AU | 2013 101 347 | 11/2013 |

OTHER PUBLICATIONS

International Search Report and Written Opinion for PCT/US2018/027345, dated Sep. 13, 2018.

*Primary Examiner* — Moshe Wilensky
(74) *Attorney, Agent, or Firm* — Justin K. Murray

(57) ABSTRACT

A method for constructing a cold box module and resulting apparatus is provided. The method can include providing a cold box module having framing and an upper and lower module sections, introducing an upper column section longitudinally into the upper module section while the upper module section is substantially horizontal; introducing a lower column section longitudinally into the lower module section while the lower module section is substantially horizontal; releasably attaching the lower column section to the lower module section using shipping saddle spacers and support saddles; and attaching a skirt attachment to the lower column section and the lower module section, wherein the skirt attachment is configured to limit longitudinal movement of the lower column section when the lower module section is in a horizontal position during transport. After erecting the cold box module at the installation site, the shipping saddle spacers can be removed and the upper
(Continued)

column section is lowered using a jacking system located on the roof of the cold box module.

7 Claims, 7 Drawing Sheets

(52) U.S. Cl.
CPC ..... *F25J 3/04412* (2013.01); *F25J 3/04654* (2013.01); *F25J 3/04896* (2013.01); *F25J 2290/42* (2013.01); *F25J 2290/70* (2013.01)

METHOD FOR CONSTRUCTING A COLD BOX MODULE

RELATED APPLICATIONS

This application claims priority to U.S. Provisional Application Ser. No. 62/484,561 filed on Apr. 12, 2017, which is hereby incorporated by reference in its entirety.

TECHNICAL FIELD OF THE INVENTION

The present invention relates to a method and design for assembly of a cold box that may be shipped as a packaged unit, complete with distillation column inside, as well as methods and design for erecting said cold box at the installation site.

BACKGROUND OF THE INVENTION

Large distillation columns used for air separation are typically constructed in fabrication shops and then transported to their installation sites via roads and waterways.

The main distillation column typically includes a two-column system for nitrogen-oxygen separation featuring a high-pressure column and a low-pressure column, which are arranged one on top of the other, thereby forming a "double column." A main condenser, which is generally disposed between the two columns, is constructed as a condenser-vaporizer and allows for heat-exchanging communication for the high-pressure column and the low-pressure column. The distillation column system, in addition to the nitrogen-oxygen separation columns, may additionally include further apparatus for obtaining high-purity products and/or other air components, in particular noble gases, for example an argon production apparatus comprising a crude argon column and optionally a pure argon column and/or a krypton-xenon production apparatus.

A "cold box" as used herein is to be understood as meaning an insulating enclosure, which completely encompasses a thermally insulated interior in outer walls; plant components to be insulated, for example one or more separation columns and/or heat exchangers, are arranged in the interior. The insulating effect may be brought about through appropriate engineering of the outer walls and/or by filling the interspace between the plant components and the outer walls with insulating material. The latter version preferably employs a powdered material such as, for example, perlite. Not only are the columns and the main heat exchanger enclosed within the cold box, but other cold plant components are enclosed by one or more cold boxes as well, which can make the resulting cold boxes quite large.

The external dimensions of the cold box usually determine the in-transit dimensions of the package in the case of prefabricated plants. The "height" of a cold box is to be understood as meaning the dimension in the vertical direction based on the orientation of the cold box in plant operation; the "cross section" is the area perpendicular thereto (the horizontal). The longitudinal axis of the cold box and column is the axis parallel with the height. In transit, the cold box is shipped in a horizontal fashion, and therefore, the height of the cold box determines the in-transit length and the cross section determines the in-transit height and width.

Air separation packages are typically fabricated in a factory, which is generally remote from the installation site of the air separation plant. This allows some substantial prefabrication and hence some minimization of the construction requirements at the installation site, where conditions are often times more unpredictable. The prefabricated package or packages are transported from the factory to the installation site, the cold-box package with one or more separation columns in a horizontal arrangement. Package length and width are subject to restrictions for this kind of transportation. This technology has hitherto only been used for medium-sized air separation plants when the columns are at least partly packed with structured packings, since packed columns generally require a greater installed height than plate columns.

In installations using relatively large columns, a lower degree of prefabrication is typically used due to the unavoidable transportation constraints, and therefore, more actions must be undertaken on-site. This is particularly true for the cold box, which for larger plants, is typically erected and installed at the installation site once the columns and other equipment are already in place.

Therefore, there is clearly a need for a manufacturing method and device that would allow for larger air separation plants to be delivered and installed with a minimal amount of installation time by using prefabricated packages.

SUMMARY OF THE INVENTION

The present invention is directed to a device and a method that satisfies at least one of these needs. Certain embodiments of the present invention relate to a method of designing a cold box module that can be shipped in one or two pieces, depending on transportation limitations, without having to completely redesign the overall package. In other words, a single cold box module design can be used independent of whether the module will be shipped as a single box or as an upper box and a lower box.

In one embodiment, the invention can include a method and apparatus for inserting the distillation column into the cold box structure. In this embodiment, the cold box structure and distillation column are both laid in a horizontal fashion. A first carriage and a second carriage are installed inside the cold box structure. The column is transported nearby the opening of the cold box and is preferably aligned with the center line of the cold box. The column is then lifted up, preferably using overhead cranes, and then moved towards the carriages inside of the cold box until one of the support saddles is supported by one of the carriages. The nearest crane is then released. The remaining portion of the column is then slid into further into the cold box, either with the use of the second crane, or by using a flat bed trailer that is adjusted to the appropriate height. The column is again lifted using a crane and slid further into the cold box until the second support saddle can be supported by the second carriage. The two carriages are then moved towards the top of the cold box structure to the appropriate distance. In one embodiment, lifting jacks can be used to temporarily support the column and allow for removal of the carriages from the cold box structure. In one embodiment, a structural spacer can be installed underneath the support saddles before removal of the lifting jacks. The structural spacers are preferably steel, but any material that can support the weight of the column during shipment can be used.

In one embodiment, the cold box module can include four support saddles that act as supports for the distillation column during transport while the distillation column is in a horizontal position. The support saddles can be attached to the inner frame of the cold box as well, thereby transferring the weight of the distillation column to the structure of the cold box. After the cold box structure has been installed in a vertical position at the installation site, the structural spacers can be removed, thereby limiting heat transfer from the column to cold box via conduction.

In another embodiment, the cold box module can include a skirt attachment at the bottom of the distillation column (e.g., bottom portion of the high pressure column). The skirt is configured to limit lateral forces (e.g., side to side and front to back) of the distillation column during transit from the fabrication facility to the erection site.

In another embodiment, the cold box module can include pre-installed platforms disposed at locations that are operable to give a user access to pre-assembled ducts. In instances where there are two cold boxes located side by side (e.g., air separation cold box and an argon cold box), this advantageously provides the worker with an access and work space to connect the ducts from one cold box to the other, without the expense and time of constructing temporary scaffolding, as is traditionally done. This is particularly useful with argon modules.

In another embodiment, field costs can be further minimized by including pre-installed lighting, utility lines, and connectors for tooling (e.g., pneumatic, electrical, etc. . . . ) and for welding equipment. This advantageously increases worker safety and minimizes installation time by eliminating the need for lengthy extension cords and removing unnecessary tripping hazards, while also reducing the amount of equipment the worker must bring up to the elevated working platform.

In another embodiment, large safety valves that are typically located on the roof of the cold box can be relocated to the platform level.

In another embodiment, the cold box module can also include a stairway module that can be attached to the cold box module in the field.

In another embodiment, the method for installing the cold box when shipped in two sections can include installing the bottom cold box section in a vertical orientation, and then lifting the top cold box section and placing the top cold box section on top of the bottom cold box section. In one embodiment, instead of welding the two sections together, the two sections can be bolted together. Bolting the two cold box sections together instead of welding greatly reduces field time and necessary equipment.

In yet another embodiment particularly useful in which the cold box module is to be shipped in two pieces (i.e., an upper module section and a lower module section), the cold box module can include a jacking system disposed on the roof of the upper module section. This jacking system is configured to lower the upper column portion onto the lower column portion in a controlled manner after the upper module section has already been connected and installed onto the lower module section. In other words, the upper column portion can be lowered while the upper cold box module remains stationary. This lowering of the upper column portion can be done without the use of an externally provided crane.

In another embodiment, the bolting connections of the lower module sections are configured to accept lifting lugs that can be bolted on and used to lift the lower module from horizontal to vertical.

In one embodiment, an apparatus for distillation at cryogenic temperatures is provided. The apparatus can include a cold box module comprising framing and having an upper module section and a lower module section, wherein the upper module comprises a roof; an upper column section disposed within the upper module section; a lower column section disposed within the lower module section; a first support saddle and a second support saddle attached to the upper module section, wherein the first support saddle is attached at an upper side portion of the upper column section and the second support saddle is attached at a lower side portion of the upper column section, wherein the first support saddle and the second support saddle are configured to provide structural support for the upper column section when the upper column section is in a horizontal position during transportation; a third support saddle and a fourth support saddle attached to the bottom module section, wherein the third support saddle is attached at an upper side portion of the lower column section and the fourth support saddle is attached at a lower side portion of the lower column section, wherein the third support saddle and the fourth support saddle are configured to provide structural support for the lower column section when the lower column section is in a horizontal position during transport; and means for limiting longitudinal movement of the lower column section when the lower module section is in a horizontal position during transport, wherein the means for limiting longitudinal movement are connected to the lower column section and the lower module section.

In optional embodiments of the apparatus for distillation at cryogenic temperatures:

- the first support saddle and the second support saddle are releasably attached to the upper module section, and wherein the third support saddle and the fourth support saddle are releasably attached to the lower module section;
- the apparatus can further include a plurality of shipping support spacers disposed between each of the first, second, third, and fourth support saddles and the framing of the cold box module;
- the upper module section and the lower module section are configured to be transported to an installation site separately;
- the apparatus can further include a plurality of a stairwell module attached to the lower module section, wherein the stairwell module is attached prior to transportation to an installation site;
- the means for limiting longitudinal movement comprises a skirt attachment comprised of a threaded rod secured by a top lock nut and a bottom lock nut;
- the skirt attachment is configured to prevent movement associated with acceleration and/or deceleration during transportation;
- the skirt attachment is configured to allow movement at oblique angles to the longitudinal axis of the lower column section, wherein the amount of movement is configured to prevent column deformation;
- the skirt attachment comprises temporary anchor bolts configured to reduce acceleration and deceleration forces during transport;
- the apparatus can further include a jacking system disposed on the roof of the upper module section, wherein the jacking system is configured to lower the upper column section towards the lower column section in a controlled manner after the upper module section and the lower module section are connected to each other in a vertical orientation;
- the apparatus can further include a jacking system disposed on the roof of the upper module section, wherein the jacking system is configured to lower the upper column independent of lowering the upper module section;
- the jacking system can further include a structural assembly; and a plurality of suspension rods supported at an upper end by the structural assembly, wherein the plurality of suspension rods is configured to provide support to the upper column section;

the structural assembly can also include a lifting frame elevated from the roof;

means for lowering the upper column section in a controlled manner; and a plurality of shipping spacers disposed between the lifting frame and the roof of the cold box;

the structural assembly is configured to allow for removal of the shipping spacers after the cold box is installed in a vertical position;

the means for lowering the upper column section in a controlled manner comprise a set of roof lock nuts engaged with the plurality of suspension rods, wherein the roof lock nuts are configured to provide a set stopping point for lowering the upper column section;

the apparatus can further include means for elevating the lifting frame off the shipping spacers;

the means for elevating the lifting frame off the shipping spacer comprises a plurality of hydraulic lift jacks;

the apparatus can further include column supports disposed on the upper column section, wherein the column supports are configured to engage with the suspension rods and transfer the weight of the upper column section to the suspension rods;

the lower module section comprises a top post at an upper end, wherein the upper module section comprises a bottom post at a lower end, wherein the top post of the lower module section and the bottom post of the upper module section are configured to be bolted together;

the top post of the lower module section is thicker than the bottom post of the upper module section, wherein filler plates are used to bolt the bottom post and the top post together; and/or the apparatus can further include a lifting lug bolted to the top post of the lower module section, wherein the lifting lug is configured for use when erecting the lower module section from a horizontal position to a vertical position at the installation site.

In one embodiment of the invention, a method for constructing a cold box module having framing and having an upper module section and a lower module section, wherein the upper module comprises a roof is provided. In one embodiment, the method can include the steps of: introducing an upper column section longitudinally into the upper module section while the upper module section is substantially horizontal; introducing a lower column section longitudinally into the lower module section while the lower module section is substantially horizontal; releasably attaching the lower column section to the lower module section using shipping saddle spacers and support saddles; attaching a skirt attachment to the lower column section and the lower module section, wherein the skirt attachment is configured to limit longitudinal movement of the lower column section when the lower module section is in a horizontal position during transport.

In optional embodiments of the method for constructing a cold box module:

the method can also include the step of providing a jacking system on the roof of the upper module section, wherein the jacking system comprises a structural assembly and a plurality of suspension rods supported at an upper end by the structural assembly and connected at a distal end to the lower column section, wherein the plurality of suspension rods is configured to limit longitudinal movement of the upper column section when the lower module section is in a horizontal position during transport;

the method can also include the step of transporting the upper module section and the lower module section while disconnected from each other to an installation site;

the method can also include the steps of erecting the lower module section from a horizontal position to a vertical position at the installation site; lifting the upper module section from a horizontal position; attaching the upper module section, while in a vertical position, to a top portion of the lower module section; lowering the upper column section, independent of the upper module section, toward the lower column section; and welding the upper column section and the lower column section together;

the step of lowering the upper column section, independent of the upper module section, toward the lower column section further comprises the steps of: positioning a plurality of lift jacks on the roof and underneath the structural assembly of the jacking system; raising the lift jacks in order to take the weight of the upper column section off of a plurality of shipping spacers; and removing the shipping spacers;

the step of lowering the upper column section, independent of the upper module section, toward the lower column section further comprises the steps of: (a) loosening a set of roof lock nuts a predetermined amount; (b) lowering the lift jacks until the roof lock nuts abut the top of the roof; and (c) repeating steps (a) and (b) until the upper column section has been lowered an acceptable distance for welding the upper column section and the lower column section together;

the method can also include the step of removing the shipping spacers after the upper module section and the lower module section are attached and before the upper column section is lowered, independent of the upper module section, toward the lower column section;

the means for lowering the upper column section in a controlled manner comprise a set of roof lock nuts engaged with the plurality of suspension rods, wherein the roof lock nuts are configured to provide a set stopping point for lowering the upper column section;

the method can also include means for elevating the lifting frame from a plurality of shipping spacers;

the means for elevating the lifting frame from the shipping spacers comprises a plurality of hydraulic lift jacks;

column supports are attached to the upper column section, wherein the column supports are configured to engage with the suspension rods and transfer the weight of the upper column section to the suspension rods after removal of shipping saddle spacers; and/or the method can also include the steps of removing the jacking system and sealing any access holes on the roof.

In another embodiment of the invention, a method for installation of a cryogenic distillation apparatus is provided. In one embodiment, the method can include the steps of: providing an upper module section having an upper column section disposed within and secured to the upper module section, wherein the upper module comprises a roof; providing a lower module section having a lower column section disposed within and secured to the lower module section; erecting the lower module section from a horizontal position to a vertical position at an installation site; lifting the upper module section from a horizontal position and attaching the upper module section, while in a vertical position, to a top portion of the lower module section; lowering the upper column section, independent of the upper module section, toward the lower column section; and welding the upper column section and the lower column section together.

In optional embodiments of the method for constructing a cold box module:

the method can further include the step of transporting the upper module section and the lower module section separately to the installation site prior to erecting the lower module section at the installation site;

the step of lowering the upper column section, independent of the upper module section, toward the lower column section further comprises the steps of: positioning a plurality of lift jacks on the roof and underneath a lifting frame 94 of a jacking system, wherein the lifting frame supports the upper column section via a plurality of suspension rods; raising the lift jacks in order to take the weight of the upper column section off of a plurality of shipping spacers; and removing the shipping spacers;

the step of lowering the upper column section, independent of the upper module section, toward the lower column section further comprises the steps of: (a) loosening a set of roof lock nuts a predetermined amount; (b) lowering the lift jacks until the roof lock nuts abut the top of the roof; and (c) repeating steps (a) and (b) until the upper column section has been lowered an acceptable distance for welding the upper column section and the lower column section together;

the upper module section further comprises a jacking system disposed on the roof of the upper module section;

the jacking system can include: a structural assembly; and a plurality of suspension rods supported at an upper end by the structural assembly, wherein the plurality of suspension rods is configured to provide support to the upper column section;

the structural assembly can include: a lifting frame elevated from the roof; means for lowering the upper column section in a controlled manner; and a plurality of shipping spacers disposed between the lifting frame and the roof of the cold box;

the method can further include the step of removing the shipping spacers after the upper module section and the lower module section are attached and before the upper column section is lowered, independent of the upper module section, toward the lower column section;

the means for lowering the upper column section in a controlled manner comprise a set of roof lock nuts engaged with the plurality of suspension rods, wherein the roof lock nuts are configured to provide a set stopping point for lowering the upper column section;

the method can further include means for elevating the lifting off the plurality of shipping spacers;

the means for elevating the lifting frame from shipping spacers comprises a plurality of hydraulic lift jacks;

column supports are disposed on the upper column section, wherein the column supports are configured to engage with the suspension rods and transfer the weight of the upper column section to the suspension rods; and/or the method can further include the steps of removing the jacking system and sealing any access holes on the roof.

In another embodiment of the invention, a method for installation of a cryogenic distillation apparatus is provided. In one embodiment, the method can include the steps of: providing an upper module section having an upper column section disposed within and secured to the upper module section, wherein the upper module comprises a roof; providing a lower module section having a lower column section disposed within and secured to the lower module section; connecting the lower module section and the upper module section together while in a horizontal position to form a cold box module, wherein there is a defined gap between a bottom of the upper column section and a top of the lower column section; erecting the cold box module from the horizontal position to a vertical position at an installation site; lowering the upper column section, independent of the upper module section, toward the lower column section; and welding the upper column section and the lower column section together.

In another embodiment, a jacking system for use in lowering an upper column section without the use of a crane is provided. In one embodiment, the jacking system is configured to be disposed on a roof of a cold box module and may include: a structural assembly; and a plurality of suspension rods supported at an upper end by the structural assembly, wherein the plurality of suspension rods is configured to provide support to the upper column section.

In optional embodiments of the jacking system:

the jacking system can also include a lifting frame elevated from the roof of the cold box module; means for lowering the upper column section in a controlled manner; and a plurality of shipping spacers disposed between the lifting frame and the roof of the cold box module;

the structural assembly is configured to allow for removal of the shipping spacers after the cold box is installed in a vertical position;

the means for lowering the upper column section in a controlled manner comprise a set of roof lock nuts engaged with the plurality of suspension rods, wherein the roof lock nuts are configured to provide a set stopping point for lowering the upper column section;

the jacking system can also include means for elevating the lifting frame off the shipping spacers;

the means for elevating the lifting frame off the shipping spacer comprises a plurality of hydraulic lift jacks; and/or the jacking system can also include column supports disposed on the upper column section, wherein the column supports are configured to engage with the suspension rods and transfer the weight of the upper column section to the suspension rods.

In another embodiment, a method for lowering, without the use of an externally provided crane, a top column section of an upper module section onto a lower column section of a lower module section after the upper module section and the lower module section have been erected in a vertical orientation and attached to each other is provided. In one embodiment, the method can include the step of lowering the upper column section, independent of an upper module section, toward the lower column section using the jacking system as described herein.

In optional embodiments of the method for lowering the top column section:

the step of lowering the upper column section, independent of the upper module section, toward the lower column section further comprises the steps of: positioning a plurality of lift jacks on the roof and underneath the structural assembly; raising the lift jacks in order to take the weight of the upper column section off of a plurality of shipping spacers; and removing the shipping spacers; and/or the step of lowering the upper column section, independent of the upper module section, toward the lower column section further comprises the steps of: (a) loosening a set of roof lock nuts a predetermined amount; (b) lowering the lift jacks until the roof lock nuts abut the top of the roof; and (c) repeating steps (a) and (b) until the upper column section has been lowered an acceptable distance for welding the upper column section and the lower column section together.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

Figure 1A:
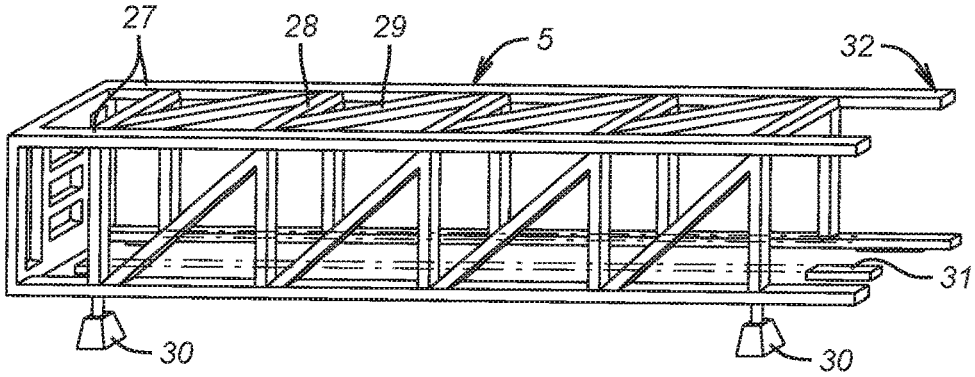
FIGS. 1A to 1D are diagrammatic perspective views of two sections of a large air distillation column and the corresponding cold box modules.
Figure 1B:
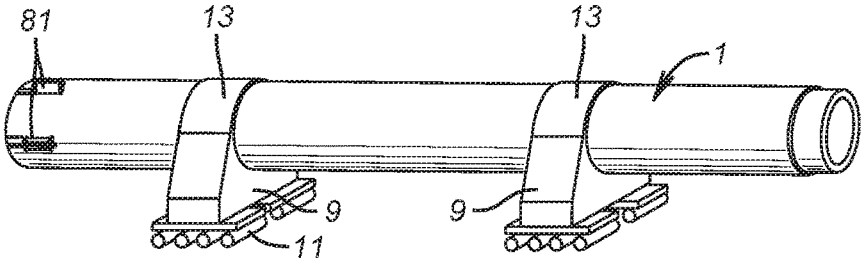
Figure 1C:
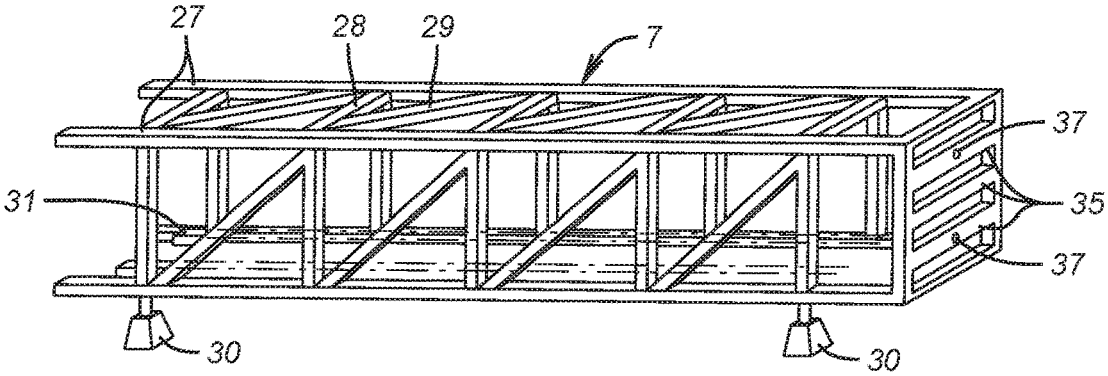
Figure 1D:
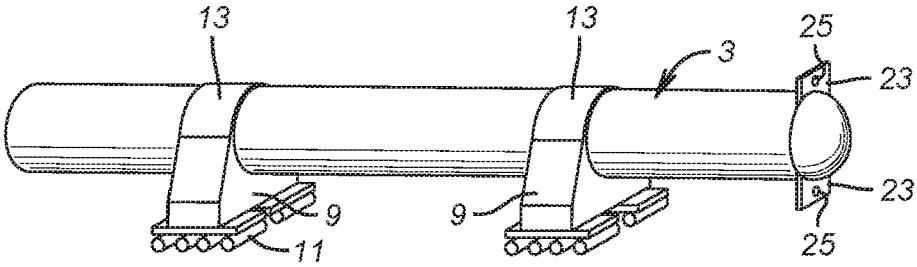

While the invention will be described in connection with several embodiments, it will be understood that it is not intended to limit the invention to those embodiments. On the contrary, it is intended to cover all the alternatives, modifications and equivalence as may be included within the spirit and scope of the invention defined by the appended claims.

FIGS. 1A to 1D show diagrammatically two sections of an air-distillation column approximately 60 meters in length and two sections of its framework, these being constructed for the purpose of implementing the method of construction according to various embodiments of the invention.

A lower column section 1 and an upper column section 3 of an air-distillation column, of cylindrical general shape, and the corresponding lower module section 5 and upper module section 7 of its framework, of parallelepipedal general shape, are placed approximately horizontally in a workshop.

Each lower column section 1 and upper column section 3 rests on two spaced-apart transverse support saddles 9, the longitudinal positions of which with respect to each column half are as described later. These support saddles 9 are provided with carriages 11 having rollers with axes approximately orthogonal to the longitudinal axes of each column section. A metal protective belt 13 goes around each column section at each saddle 9.

The lower column section 1 (FIG. 1B), which comprises the medium-pressure part and the reboiler, which are not detailed in the figures, is extended, at its lower end (to the left in FIG. 1), by a skirt system 81. Skirt system 81 is shown in more detail in FIG. 4.

Figure 4:
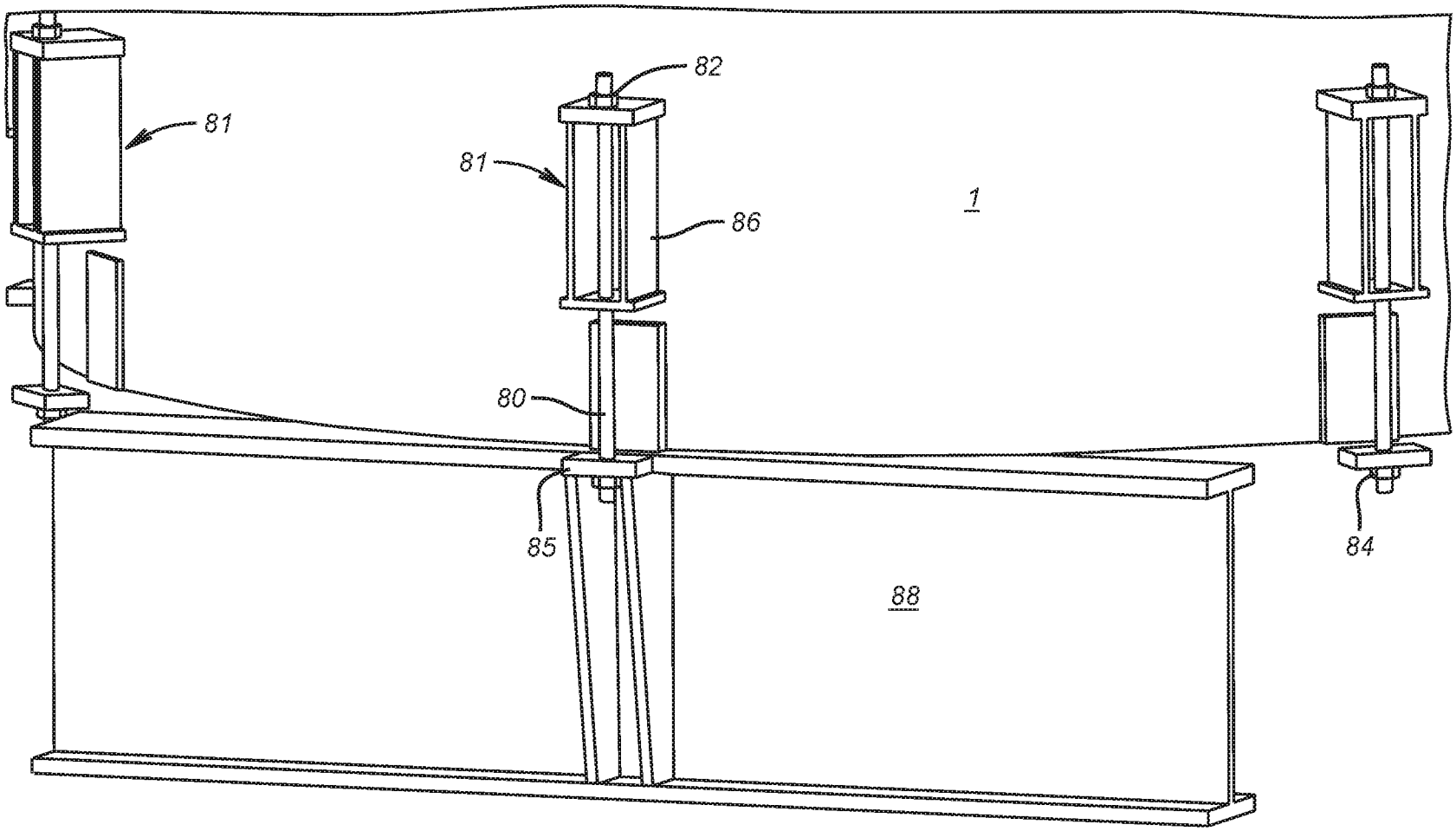
FIG. 4 is a partial isometric view of a skirt system in accordance with an embodiment of the present invention.
Figure 5B:
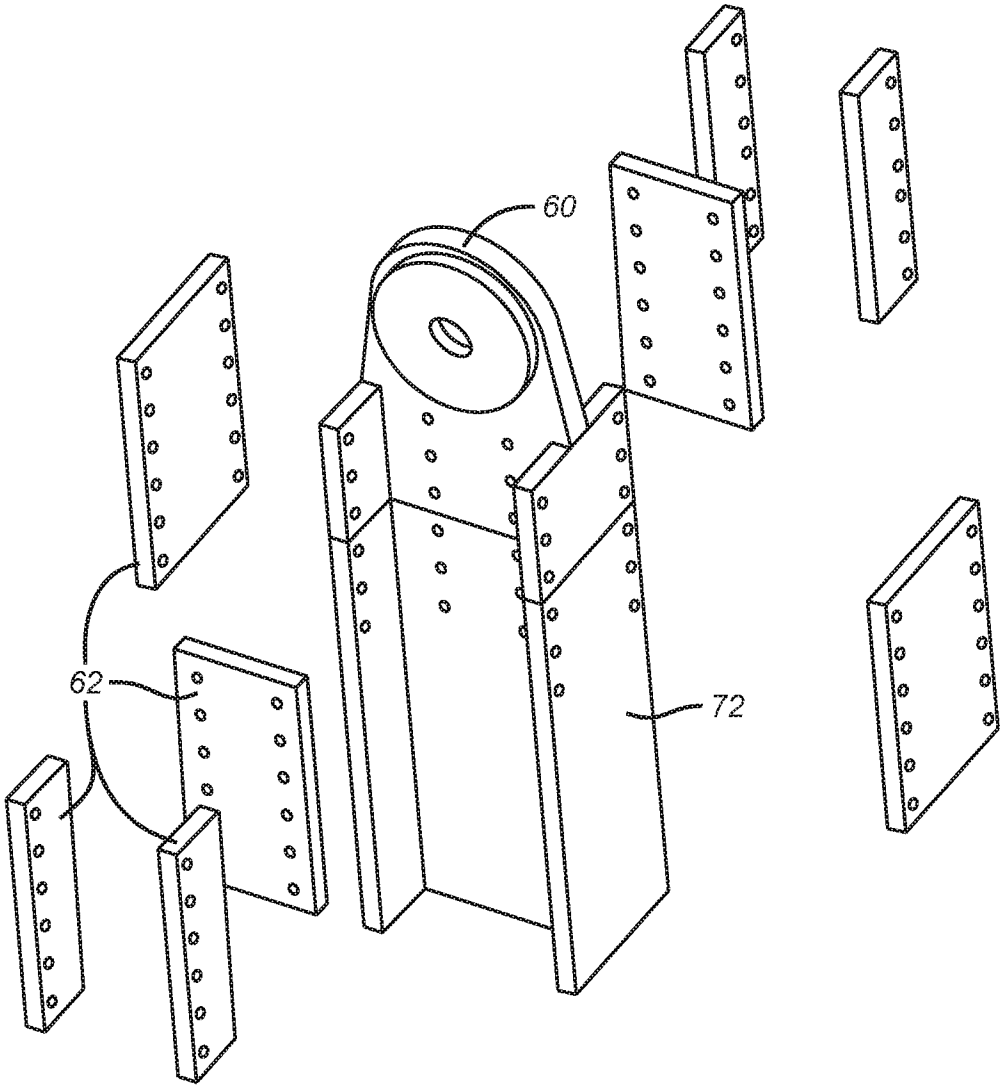
FIGS. 5A to 5B are isometric views of an embodiment of the invention.
Figure 5A:
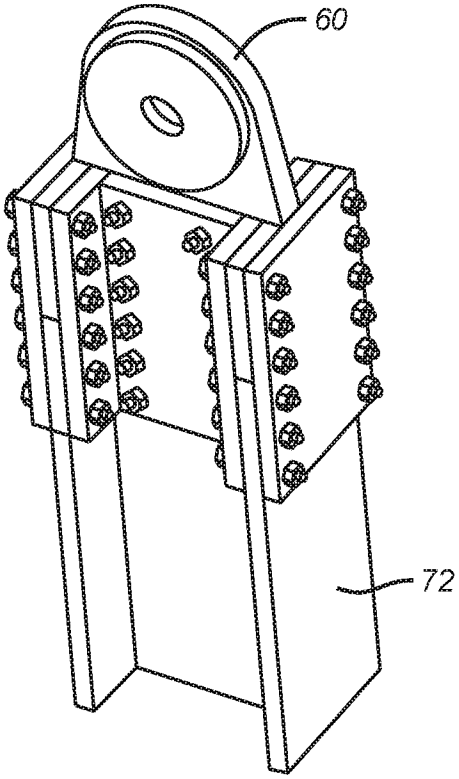

In one embodiment, the upper column section 3 (FIG. 1D) is provided near its upper end (to the right in FIG. 1D) with means for connecting threaded rods to the upper column section. In the embodiment shown, the means for connected threaded rods can include two symmetrical column supports 23 which are transverse with respect to the longitudinal axis of the half 3. These column supports 23 each have a hole 25 whose axis is parallel to the said longitudinal axis, and the rods are held in place using a locking nut. In one embodiment, tabs 23 are primarily used for providing structural support during shipment and are not configured to be able to support the entire weight of the upper column section when in the vertical position. In another embodiment, the fixing tabs can be more structurally robust such that the tabs for the weight of the upper column section in the vertical position. For example, the fixing tabs can be similar in structure to the skirt system 81 as shown in FIG. 4.

The framework (FIGS. 1A and 1C) can include a metal frame comprising four longitudinal stanchions 27 connected, on each face of the framework, by cross-members 28 and diagonal braces 29. The two framework halves (e.g., upper module section 7 and lower module section 7) each rest on four height-adjustable feet 30. Longitudinal rails 31 are placed on the internal surface of the bottom face (in FIGS. 1A and 1C) of each lower module section 5 and 7.

Figure 2B:
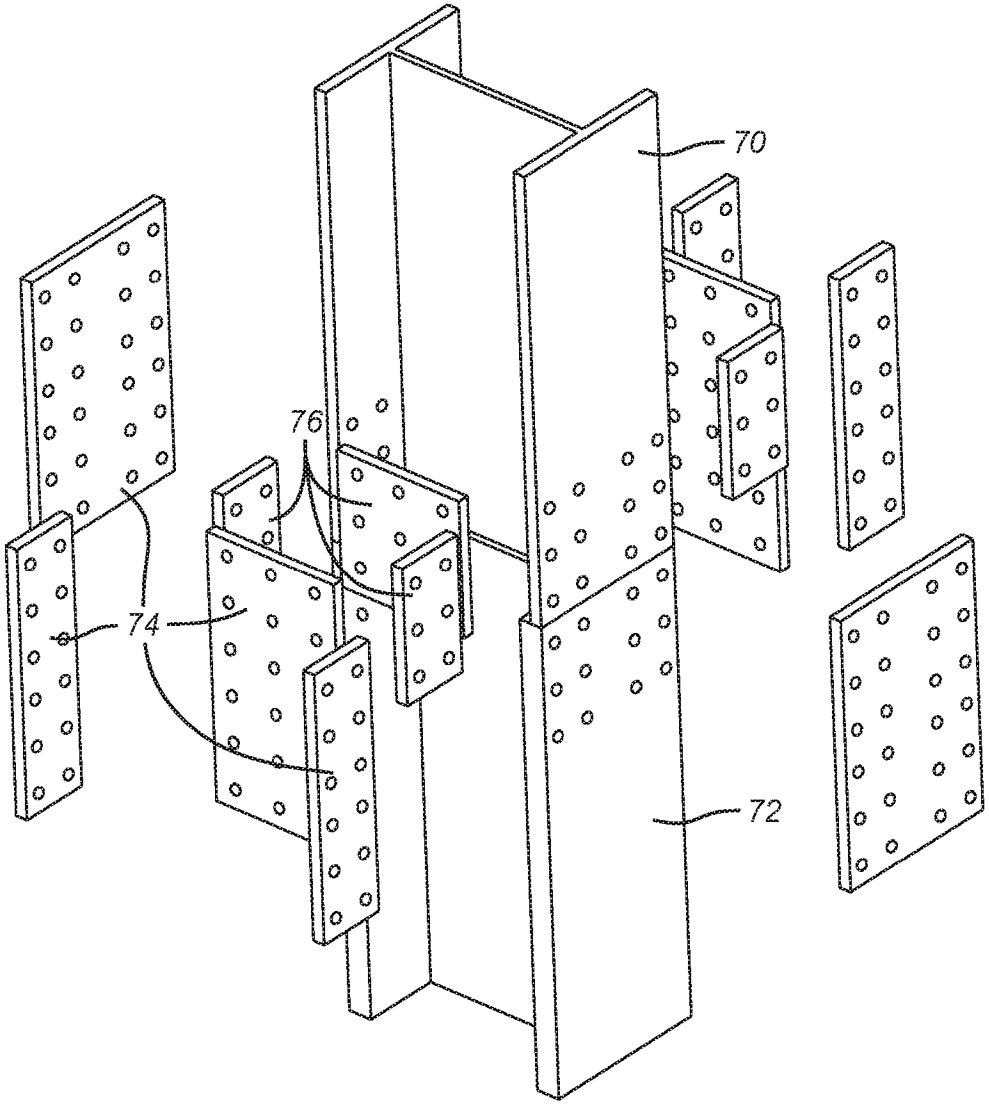
FIGS. 2A to 2B are isometric views of an embodiment of the invention.
Figure 2A:
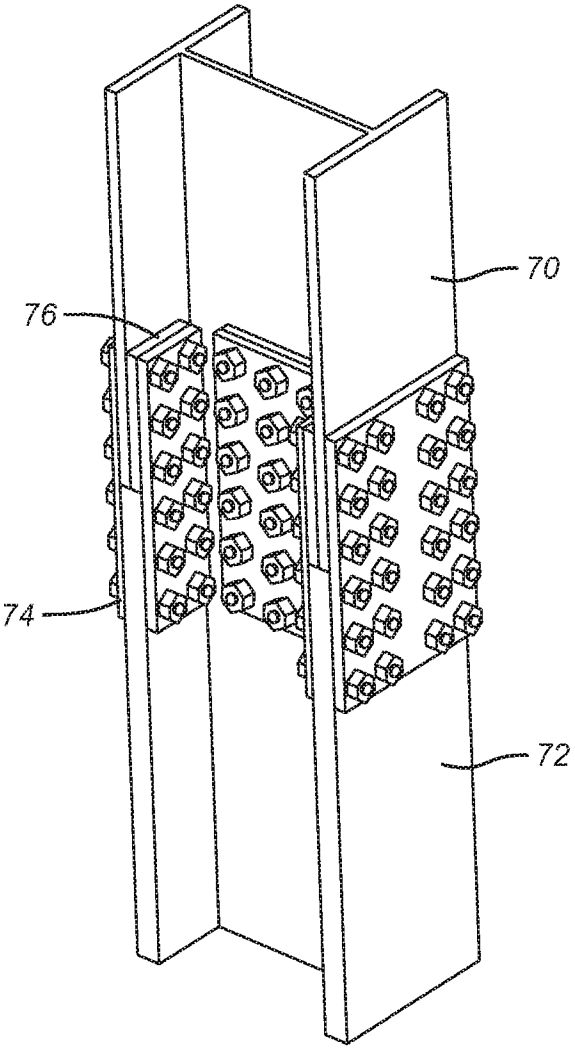

The upper end (to the right in FIG. 1A) of the lower module section 5 is provided with means for mating with the lower end (to the left in FIG. 1C) of the upper module section 7. In one embodiment, this means for mating can include a top post 70 for the upper module section 7 and a bottom post 72 for lower module section 5. As shown in FIGS. 2A and 2B, the bottom of top post 70 can be bolted to the top of bottom post 72. This is preferably achieved using a plurality of bolting plates 74. In a preferred embodiment, top post 70 is not the same thickness as bottom post 72, and therefore, filler plates 76 can be used to allow for the bolting plates 74 to be flush with both the top post 70 and the bottom post 72.

The top face (to the right in FIG. 1C) of the upper module section 7 comprises three approximately horizontal cross-members 35. The bottom and top cross-members 35 are provided with central holes 37 whose axes are parallel to the longitudinal axis of the half 7.

The bottom of the lower module section 5 (to the left in FIG. 1A) is provided with vertical and horizontal cross-members which delimit, internally to the framework, a region for supporting skirt system 81 (See FIG. 4 for more detail).

In one embodiment, to ensure that the longitudinal axis of the lower module section 5 is horizontal, the height of the feet 30 are adjusted. This positioning may be checked by using levels or another technique conventional to those skilled in the art.

Figure 3:
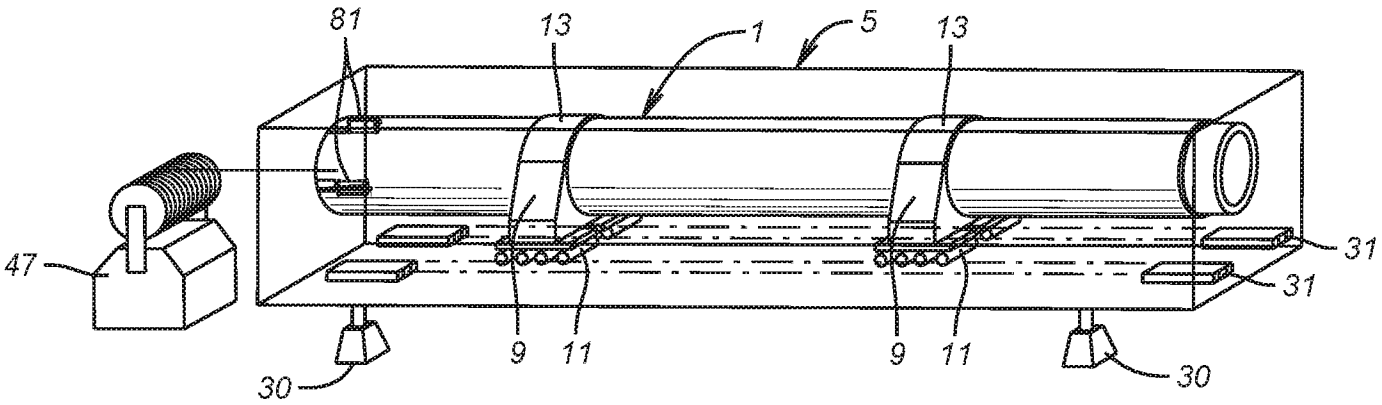
FIG. 3 is a diagrammatic perspective view illustrating the lower column section being inserted into the lower module section.

Next, the lower column section 1 is introduced into the lower module section 5, by pulling it in by means of a winch 47 connected by a cable to the lower end (to the left in FIG. 3) of the half 1, the carriages 11 being made to run along the rails 31. In an optional embodiment not shown, instead of using a winch, a set of overhead cranes may also be used to longitudinally insert the column into the framework. In one embodiment not shown, a first carriage and a second carriage are installed inside the cold box structure. The column is transported nearby the opening of the cold box and is preferably aligned with the center line of the cold box. The column is then lifted up, preferably using cranes, and then moved towards the carriages inside of the cold box until one of the support saddles is supported by one of the carriages. The nearest crane is then released. The remaining portion of the column is then slid into further into the cold box, either with the use of the second crane, or by using a flatbed trailer that is adjusted to the appropriate height. The column is again lifted using a crane and slid further into the cold box until the second support saddle can be supported by the second carriage. The two carriages are then moved towards the top of the cold box structure to the appropriate distance.

Once the framework is situation properly within the framework, a set of vertical jacks are used to raise the column by way of the support saddles 9, so that the carriages 11 can be removed. Once the runners are removed, a structural spacer is placed underneath the support saddles 9 and the cradles are then bolted to the framework. As such, the support saddles 9 and framework provide support against gravitational forces. In a preferred embodiment, temporary saddle spacers 91 can be installed in between the support saddles 9 and the framework. The saddle spacers 91 allow for the saddles 9 to receive structural support from the framework during shipment, as well as going from horizontal to vertical during installation. Once the cold box is in its vertical orientation, the temporary saddle spacers 91, can be removed, thereby reducing heat transfer from the cold box framing to the saddles (and in turn, the column).

FIG. 4 provides an alternative skirt system that can be added to the bottom portion of lower column section 1. This skirt system advantageously prevents the column from buckling during shipment by greatly reducing lateral movement due to acceleration/deceleration. In one embodiment, the skirt system allows for slight movements orthogonal to the longitudinal axis of the column. In the embodiment shown, the skirt system includes a threaded rod 80 secured by a top locking nut 82 and a bottom locking nut 84. The top locking nut is attached to a tab 86 attached to the lower column section 1, while the bottom locking nut 84 is configured to anchor the rod to the framework 88. As shown, a plurality of threaded rods and locking nuts are used to secure the column to the framework. In the embodiment shown, bracket 85 can be used to secure skirt system 81 to the framework.

The relative positioning of the top upper column section 3 in the top upper module section 7, in order to assemble the second module, is carried out as follows.

The horizontality of the upper module section 7 is checked, in a manner similar to that used for the lower module section 5, and then the upper column section 3 is pulled into the upper module section 7 as described for the first module. As mentioned earlier, upper column section 3 differs from lower column section 1 in that upper column section 3 is preferably the low pressure column of a double column. As such, during installation, upper column section 3 will need to be lowered onto lower column section 1. While a similar skirt system could be used for upper column section 3 during shipment, this skirt system would provide no additional benefits for lowering upper column section 3 during installation. Therefore, certain embodiments of the invention include a jacking system, which not only provides support during shipment, but can also be used to lower upper column section 3 onto lower column section 1 after lower module section 5 and 7 have been bolted together in the vertical position. The details of the jacking system will be described later with respect to FIG. 6 and FIG. 7.

Means for protecting the open ends of the column, its items of equipment and its framework, for example watertight covers, are then used.

The upper and lower modules sections are then ready to be transported to an industrial site. The length of these modules, which can be less than 30 m, allow them to be transported by conventional means.

These module sections can be assembled on site as described below.

Lifting lug 60 is bolted onto the top section of bottom post 72 using a plurality of lifting lug bolting plates 62. In a preferred embodiment, lifting lug 60 is the same thickness as bottom post 72, and therefore, filler plates do not need to be used when bolting lifting lug 60 to the bottom post 72.

The lower module section is lifted using means known in the art (e.g., large crane), and then the bottom of the lower module section 5 (to the left in FIG. 1A) can be preferably placed on height-adjustable feet, for example, at the four corners of the framework bottom. The verticality of the longitudinal axis of the lower module section 5 is then checked, for example by means of a sighting device or any other technique conventional to those skilled in the art.

Since the longitudinal axis of the lower column section 1 is preferably parallel to the longitudinal axis of the lower module section 5, the verticality of the lower column section 1 is easily checked, by modifying the respective height of the feet on which the lower module section 5 rests.

The setting of the lower module section with respect to the ground of the industrial site is then frozen, and then, for example using cranes, the upper module section is placed on top of the lower modules section, and the top post and bottom post are bolted together as shown in FIGS. 2A and 2B.

In one embodiment, the upper column section is held by four threaded rods 57 from the jacking system 90 located on the cold box roof 100 and the column supports 23 for the rods. In one embodiment, the top column section 3 is transported in a configuration that is elevated higher than necessary (along the longitudinal axis), thereby providing a space between the top column section and the bottom column section when the two cold box sections are mated. This created space helps to avoid damage to the column sections during assembly on-site. This gap is closed by lowering the top column down slowly.

In another embodiment, the jacking system 90 is configured to lower the upper column section independent of lowering the upper module section. This advantageously allows for lower installation costs, since a large crane is not needed to make the last portion of high precision lowering. In short, the crane is not needed, since the entire weight of the upper column section 3 is supported by the jacking system 90, which in turn is structurally supported by the cold box assembly.

Therefore, once the upper and lower module sections of the cold box module are assembled and secured, the large cranes can be removed and the final column assembly can be done at any time afterwards without the help of any large lifting equipment and with a controlled environment avoiding any risks of weather compromising the on-going operation of the final assembly.

In one embodiment, the jacking system includes a structural steel assembly installed on the roof of the cold box, and is preferably configured to allow the use of hydraulic jacks to lower the upper column section, which in one embodiment can be supported by four threaded rods, at a rate that it is controlled by the field personnel to make the final column assembly with the lower column section. In one embodiment, the upper section of the top cold box section includes additional structural enhancements (e.g., extra bracing, framing, stiffeners) underneath the location of the hydraulic jacks to accommodate the added stress loads during the lowering of the top column.

Figure 6:
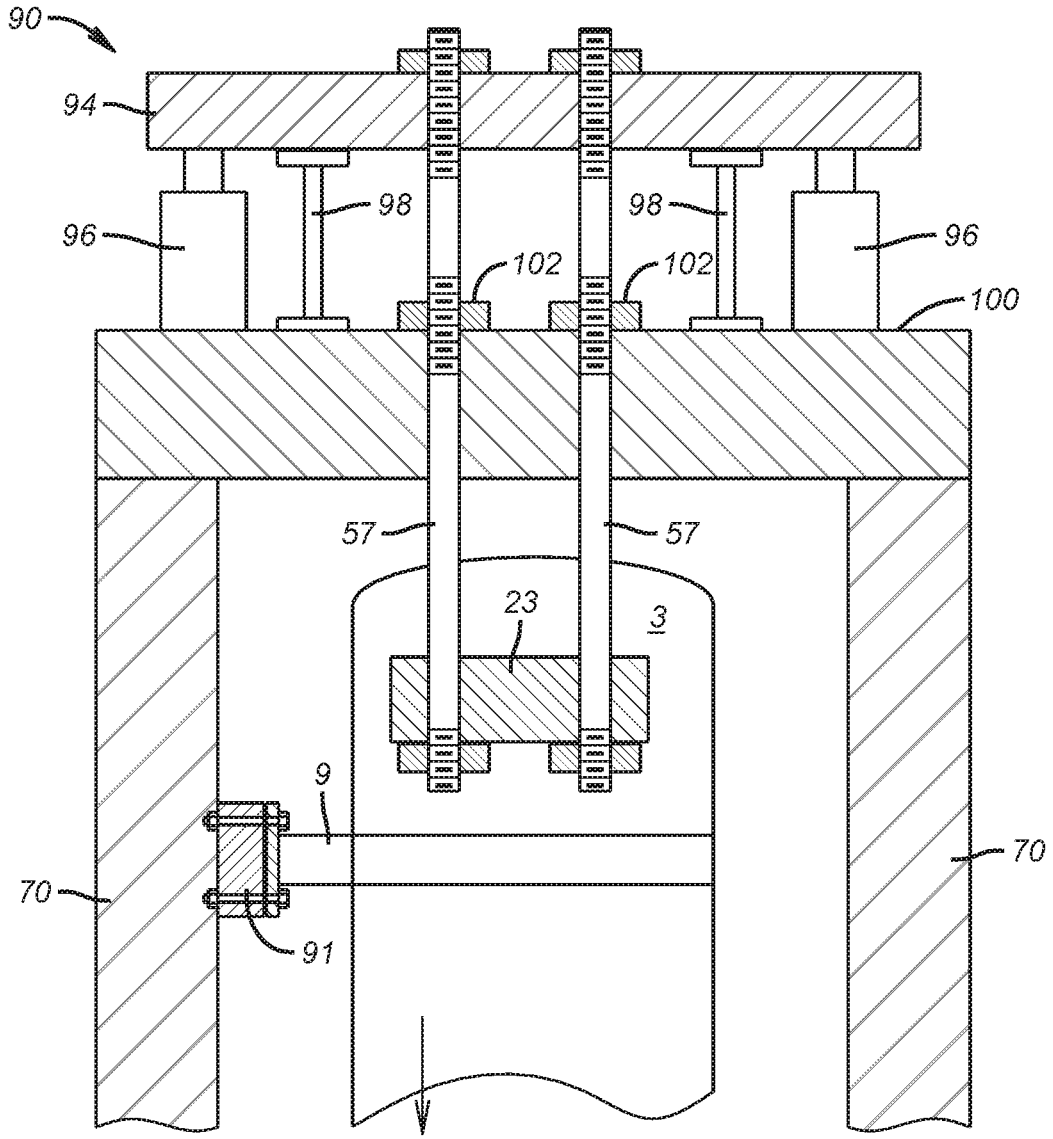
FIG. 6 is a partial cross sectional view of a top portion of the upper module section in the vertical position.

FIG. 6 provides a side cutaway view of one embodiment of the jacking system 90. After the top and bottom cold box assemblies are connected and made vertical, the temporary saddle spacers 91 can be removed. At this point, the entire weight of the upper column section 3 is now being supported by the jacking system 90 and rods 57, and the upper column section 3 can now be moved downward. Since the weight of the upper column section is so great (easily can exceed 100 tons), the lowering of the column should be done with great care and control.

In one embodiment, the method for lowering the upper column section independent of the cold box structure can include the steps of providing a plurality of jack lifts 96 on the roof 100 of the cold box structure and positioning them underneath a lifting frame 94 of the jacking system. The jack lifts 96 are then raised in order to take the weight of the column off of the temporary shipping spacers 98, and the shipping spacers 98 can then be removed. In a preferred embodiment, shipping spacers are made of steel; however, those of ordinary skill in the art will recognize that any material can be used for the shipping spacers, so long as the shipping spacers can provide the requisite structural strength and support during shipment and erection to vertical position.

The roof lock nuts 102 are then all equally loosened a predetermined amount, for example a quarter of an inch. The jack lifts 96 are all then lowered until the roof lock nuts 102 are abutting the top of the roof. The jack lifts are then slightly raised to take enough stress off the roof lock nuts so that they can again be loosened the appropriate distance, and the jack lifts are again lowered until the roof lock nuts abut the roof. This process is repeated until the upper column section is appropriately mated with the bottom column.

The column halves 1 and 3 are then welded together, filling the few millimeters provided between the upper and lower column sections with a weld bead. The items of equipment for the bottom module and the top module are connected. In an optional embodiment, the jacking assembly and threaded rods can then be removed from the system and the remaining holes in the roof can be appropriately sealed.

Figure 7:
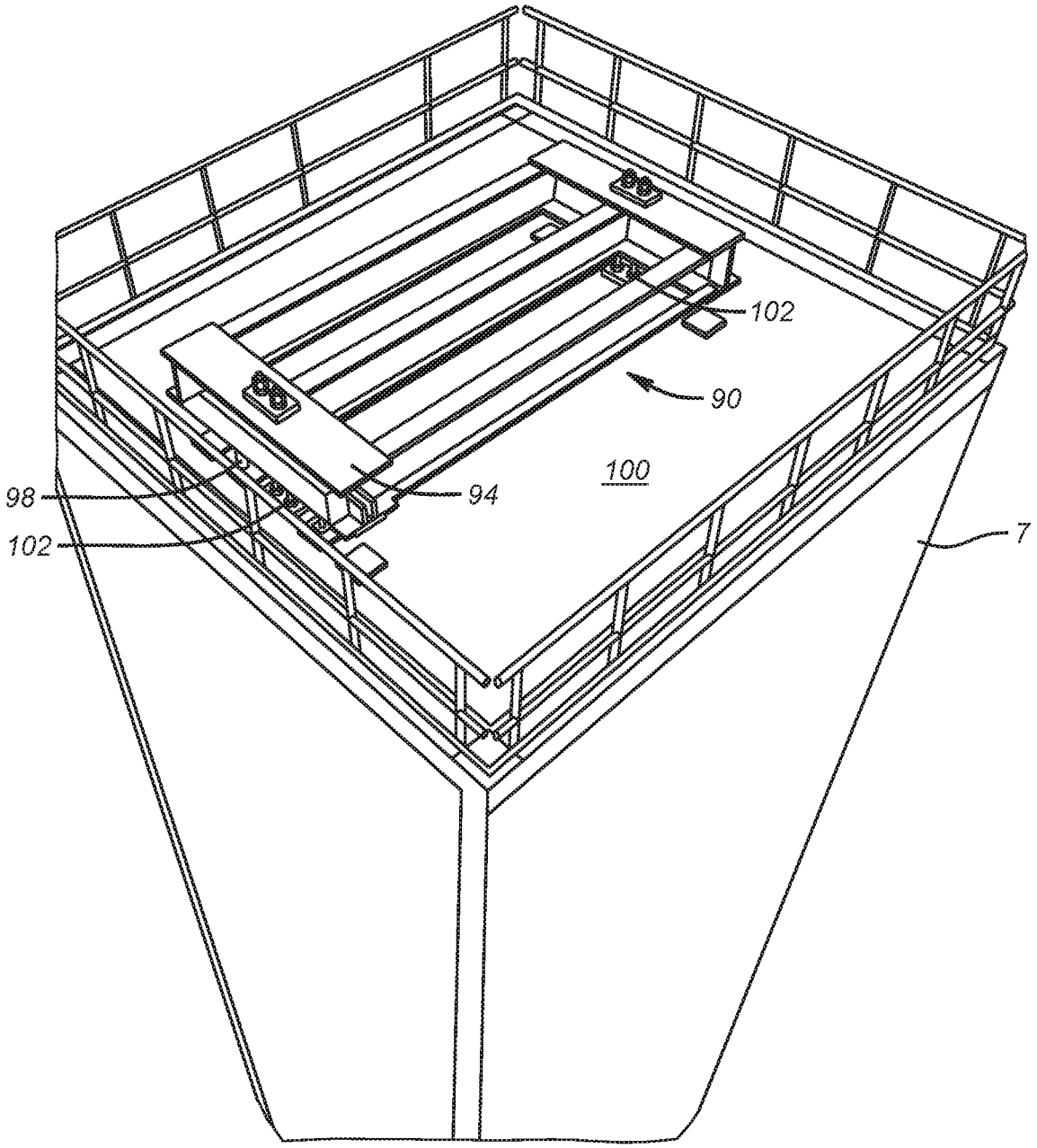
FIG. 7 is an isometric view showing the jacking system installed on the roof of the cold box module.

FIG. 7 provides an isometric view of the cold box module with jacking system installed on the roof.

In another embodiment, it is also possible to bolt the top cold box assembly to the bottom cold box assembly at the installation site while still in the horizontal position, and then raise the entire cold box assembly to the vertical position in one piece. Overall weight of the cold box assembly and lifting capacity of available cranes can be factors in determining whether the cold box assembly is vertically erected in one or two pieces.

The method and apparatus according to certain embodiments of the invention therefore allow factory preassembly of a large distillation column and its framework into transportable modules and allows, on site, rapid vertical assembly meeting the verticality constraints imposed on distillation columns.

As such, embodiments of the invention can improve overall project costs and reduce design and installation time. In preferred embodiments, the invention can have the following advantages:

- Largest and heaviest packages which can be broken into smaller sub-modules or packages without modification of overall conceptual design, manufacturing, transportation, lifting and erection;
- Improve assembly and dis-assembly method to minimize welding on site;
- Employ quick couplings (no welding) for large bore warm end piping for LP circuit, where possible;
- Minimize the needs for scaffolding; and/or
- Packages/Modules completely assembled, instrumented, tested, painted and insulated (where possible) at manufacturing facility In another embodiment, the cold box module is an argon cold box, which can include pre-assembly ducts that are configured to be connected to an ASU Cold Box in the field. In another embodiment, the cold box module can include pre-assembled and permanent platforms for both construction and maintenance purposes (depending on the shipping constraints, could be partly dis-assembled), which avoids the use of temporary platforms and scaffolding to complete the connections and for final field assembly.

In designs known heretofore, the design for both ASU and Argon Cold Boxes was such that all the large safety valves were located at the roof. These safety valves, piping spools and related supports had to be installed in the field at approximately 60 meters (approx 197'-0") height, thereby increasing risks and safety issues associated with working at these height for several days (loss of productivity), necessitating large crane (costs), and requiring the use of diaphragms at the lines penetrating the roof to seal the cold box against the ambient air and humidity including rain, thereby creating an additional risk of water leaking inside the cold box.

For example, water leaking within the cold box near the top of a cryogenic distillation column could contact the perlite (insulation used within the cold box), causing the perlite to freeze, which reduces the contraction and expansion of these lines penetrating the roof and/or potentially adding weight on theses lines as well as the lines or instrument tubing nearby or located below the icing formation. In certain embodiments of the invention, these problems are reduced and/or eliminated.

By relocating the various valves at a lower platform area, safety risks are minimized, usage of cranes is reduced, water leakage is reduced, and there are greatly reduced problems associated with freezing.

Those of ordinary skill in the art will recognize that embodiments of the invention provide an innovative approach and effective strategy for solving the current limitations of today's technology. Certain embodiments of the invention help to provide manufacturing flexibility and reactivity by allowing additional capacities to current manufacturing techniques; serve all parts of the world, particularly those that are landlocked; reduce the need for oversized transportation equipment; provide manufacturing capabilities to areas in high growth markets that do not currently have the necessary infrastructure for large transportation equipment.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, language referring to order, such as first and second, should be understood in an exemplary sense and not in a limiting sense. For example, it can be recognized by those skilled in the art that certain steps can be combined into a single step.

The singular forms "a", "an", and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

We claim:

1. A method for constructing a cold box module, the cold box module comprising framing and having an upper module section and a lower module section, wherein the upper module comprises a roof, the method comprising the steps of:

introducing an upper column section longitudinally into the upper module section while the upper module section is substantially horizontal;

introducing a lower column section longitudinally into the lower module section while the lower module section is substantially horizontal;

releasably attaching the lower column section to the lower module section using shipping saddle spacers and support saddles;

attaching a skirt attachment to the lower column section and the lower module section, wherein the skirt attachment is configured to limit longitudinal movement of the lower column section when the lower module section is in a horizontal position during transport;

providing a jacking system on the roof of the upper module section, wherein the jacking system comprises a structural assembly and a plurality of suspension rods supported at an upper end by the structural assembly and connected at a distal end to the upper column section, wherein the plurality of suspension rods is configured to limit longitudinal movement of the upper column section when the upper module section is in a horizontal position during transport, transporting the upper module section and the lower module section while disconnected from each other to an installation site;

erecting the lower module section from a horizontal position to a vertical position at the installation site;

lifting the upper module section from a horizontal position;

attaching the upper module section, while in a vertical position, to a top portion of the lower module section;

lowering the upper column section, independent of the upper module section, toward the lower column section; and welding the upper column section and the lower column section together, wherein the step of lowering the upper column section, independent of the upper module section, toward the lower column section further comprises the steps of: positioning a plurality of lift jacks on the roof and underneath the structural assembly of the jacking system; raising the lift jacks in order to take the weight of the upper column section off of a plurality of shipping spacers; and removing the shipping spacers.

2. The method as claimed in claim 1, wherein the step of lowering the upper column section, independent of the upper module section, toward the lower column section further comprises the steps of: (a) loosening a set of roof lock nuts a predetermined amount; (b) lowering the lift jacks until the roof lock nuts abut the top of the roof; and (c) repeating steps (a) and (b) until the upper column section has been lowered an acceptable distance for welding the upper column section and the lower column section together.

3. The method as claimed in claim 1, further comprising the step of removing the shipping spacers after the upper module section and the lower module section are attached and before the upper column section is lowered, independent of the upper module section, toward the lower column section.

4. The method as claimed in claim 1, wherein a means for lowering the upper column section in a controlled manner is used during the step of lowering the upper column section, independent of the upper module section, toward the lower column section, and the means for lowering the upper column section in a controlled manner comprise a set of roof lock nuts engaged with the plurality of suspension rods, wherein the roof lock nuts are configured to provide a set stopping point for lowering the upper column section.

5. The method as claimed in claim 1, further comprising column supports attached to the upper column section, wherein the column supports are configured to engage with the suspension rods and transfer the weight of the upper column section to the suspension rods after removal of shipping saddle spacers.

6. The method as claimed in claim 1, further comprising the steps of removing the jacking system and sealing any access holes on the roof.

7. A method for constructing a cold box module, the cold box module comprising framing and having an upper module section and a lower module section, wherein the upper module comprises a roof, the method comprising the steps of:

introducing an upper column section longitudinally into the upper module section while the upper module section is substantially horizontal;

introducing a lower column section longitudinally into the lower module section while the lower module section is substantially horizontal;

releasably attaching the lower column section to the lower module section using shipping saddle spacers and support saddles;

attaching a skirt attachment to the lower column section and the lower module section, wherein the skirt attachment is configured to limit longitudinal movement of the lower column section when the lower module section is in a horizontal position during transport; and providing a jacking system on the roof of the upper module section, wherein the jacking system comprises a structural assembly and a plurality of suspension rods supported at an upper end by the structural assembly and connected at a distal end to the upper column section, wherein the plurality of suspension rods is configured to limit longitudinal movement of the upper column section when the upper module section is in a horizontal position during transport, wherein the structural assembly is comprised of a lifting frame elevated from the roof, means for lowering the upper column section in a controlled manner; a plurality of shipping spacers disposed between the lifting frame and the roof of the cold box, and means for elevating the lifting frame from the plurality of shipping spacers, wherein the means for elevating the lifting frame from the plurality of shipping spacers comprises a plurality of hydraulic lift jacks.

* * * * *